US010488166B2

(12) United States Patent
Liptaak

(10) Patent No.: US 10,488,166 B2
(45) Date of Patent: Nov. 26, 2019

(54) GAS CHECK FOR PROJECTILES

(71) Applicant: Moxie Ventures, LLC, Potlach, ID (US)

(72) Inventor: Charles Liptaak, Potlach, ID (US)

(73) Assignee: Moxie Ventures, LLC, Danbury, CT (US)

( * ) Notice: Subject to any disclaimer, the term of this patent is extended or adjusted under 35 U.S.C. 154(b) by 0 days.

(21) Appl. No.: 16/153,551

(22) Filed: Oct. 5, 2018

(65) Prior Publication Data

US 2019/0107373 A1 Apr. 11, 2019

Related U.S. Application Data

(60) Provisional application No. 62/568,519, filed on Oct. 5, 2017.

(51) Int. Cl.
*F42B 14/02* (2006.01)

(52) U.S. Cl.
CPC ..... *F42B 14/02* (2013.01)

(58) Field of Classification Search
CPC ..... F42B 14/02
USPC ..... 42/78; 102/524, 525, 526, 527
See application file for complete search history.

(56) References Cited

U.S. PATENT DOCUMENTS

| | | | | |
|---|---|---|---|---|
| 167,981 | A | 9/1875 | Broadwell | |
| 325,878 | A | 9/1885 | Tyler | |
| 1,376,130 | A | 4/1921 | Asbury | |
| 2,809,587 | A * | 10/1957 | Walton | F42B 14/02 102/527 |
| 4,797,985 | A * | 1/1989 | Prochnow | C23C 4/02 102/524 |
| 5,686,693 | A * | 11/1997 | Jakobsson | F42B 12/72 102/501 |
| 6,763,765 | B2 | 7/2004 | Crowson | |
| 7,380,505 | B1 | 6/2008 | Shiery | |
| 2005/0115451 | A1 | 6/2005 | Crowson | |
| 2006/0027130 | A1 | 2/2006 | Parker | |

FOREIGN PATENT DOCUMENTS

WO WO 2012/140628 * 10/2012

OTHER PUBLICATIONS

"Formula for Gas Check material thickness," http://castboolits.gunloads.com/showthread.php?285312-Formula-for-Gas-Check-material-thickness, published Aug. 12, 2015, 3 pages.

* cited by examiner

*Primary Examiner* — Stephen Johnson
(74) *Attorney, Agent, or Firm* — Lee & Hayes, P.C.

(57) ABSTRACT

A projectile that includes a body and a bearing surface that extends cylindrically across a portion of the body. A gas check is formed in the bearing surface that includes at least one relief band. The relief band extends annularly through the bearing surface. A profile of the relief band is bilaterally symmetrical about a central plane, and a shape of the profile on a side of the central plane is defined by a plurality of intersecting segments. The segments include a central segment portion located at a lowest point of the profile, an upper side segment located at a highest point of the profile, a rising segment that extends at an acute angle from the central segment portion toward the upper side segment, and a curved segment that connects the upper side segment and the rising segment.

9 Claims, 4 Drawing Sheets

GAS CHECK FOR PROJECTILES

CROSS REFERENCE TO RELATED PATENT APPLICATION

This application claims priority to U.S. Provisional Patent Application No. 62/568,519, filed Oct. 5, 2017, the content of which is incorporated herein by reference.

BACKGROUND

Gas checks have been in use in munitions since the 1800s. Application of gas checks ranges from use in artillery to pistol and rifle rounds. Gas checks serve many different purposes based on the particular application. In the case of monolithic solid brass/copper projectiles, gas checks are used to prevent buildup of excessive chamber pressures and allow these rounds to achieve velocities comparable to jacketed lead counterparts, while keeping pressures at or below Sporting Arms and Ammunition Manufacturers' Institute ("SAAMI") maximums. In some instances, gas checks are formed as bands that protrude above the surface of the projectile. In other instances, gas checks are formed as rings in the surface of the projectile.

A commonly used form of gas check is a square-cut gas check, in which annular, square-edged grooves are cut or formed into the bearing surface of a projectile. Thus, leaving a series of cylindrical relief bands alternating with drive bands having the same outer diameter as the bearing surface of the projectile. One major drawback of square-cut gas checks is that the shape of the drive bands and relief bands on gas checks produces aerodynamic drag and turbulence. Indeed, in some instances, turbulence is created around the grooves and rings, as well as increased behind the bullet upon firing. See, for example, the simulated turbulence of a projectile 100A traveling at 2000 fps without a gas check compared to the turbulence behind a projectile 100B with a gas check having square-edged drive bands and relief bands on the bearing surface, in FIG. 1. Note the increased turbulence around and behind the projectile 100B.

BRIEF DESCRIPTION OF THE DRAWINGS

The Detailed Description is set forth with reference to the accompanying figures. In the figures, the left-most digit(s) of a reference number identifies the figure in which the reference number first appears. The use of the same reference numbers in different figures indicates similar or identical items. Furthermore, the drawings may be considered as providing an approximate depiction of the relative sizes of the individual components within individual figures. However, the drawings are not to scale, and the relative sizes of the individual components, both within individual figures and between the different figures, may vary from what is depicted. In particular, some of the figures may depict components as a certain size or shape, while other figures may depict the same components on a larger scale or differently shaped for the sake of clarity.

DETAILED DESCRIPTION

This disclosure is directed to gas checks on projectiles. In particular, the disclosure discusses an improved gas check with respect to bullets for pistols and rifles. The dimensions of the various structural elements (e.g., edges/corners/shape of drive bands, relief bands, etc.) of a gas check according to this disclosure vary depending on the caliber of the bullet (or round) for which the gas check structure is calculated. That is, a gas check calculated according to the instant disclosure for a .45 caliber bullet may vary from a gas check calculated for a .50 caliber bullet. Further, the difference between the gas checks of the above example calibers is more than a mere difference in the outer circumference due to the different diameters of the respective bearing surfaces of the bullets.

Figure 2:
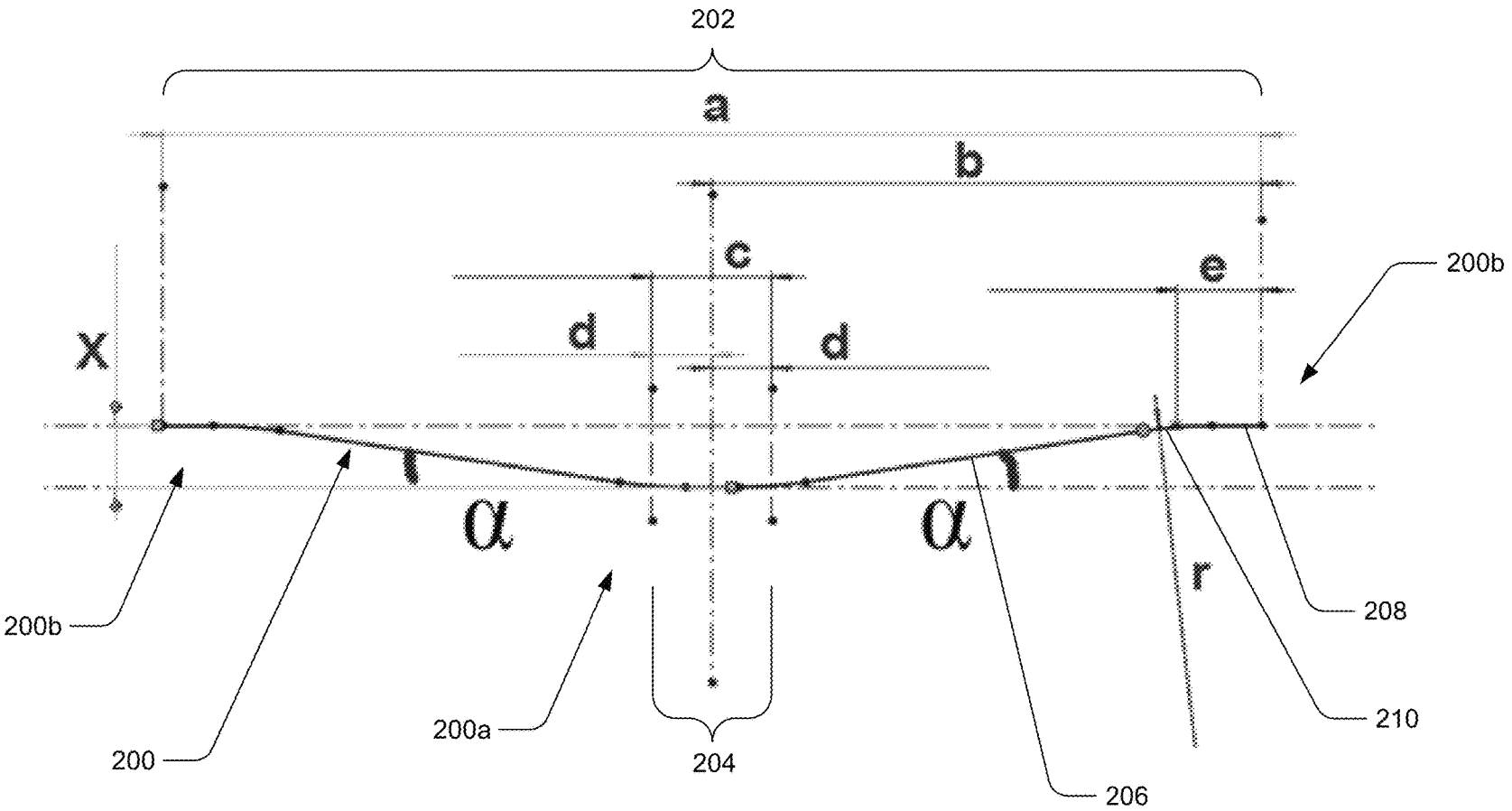
FIG. 2 illustrates the dimensional components of a profile of a single section of a gas check according to an embodiment of the instant disclosure.

Depicted in FIG. 2 is a schematic profile 200 of a relief band 200*a* and a drive band 200*b* in a section of a gas check calculated according to an embodiment of the instant disclosure, where the drive band is equal in diameter to the diameter of a representative bearing surface of a projectile. In the event only a single relief band is incorporated into a bearing surface, the lateral sides of the relief band may alternatively be referred to simply as the bearing surface abutting a relief band. However, it is contemplated that a projectile may include several consecutively spaced relief bands, and that the material in between two relief bands is then referred to as a drive band. In an embodiment, the respective, consecutive relief bands and intervening drive bands of a gas check may be evenly spaced apart, or alternatively, may be spaced at varying (e.g., increasing or decreasing) sizes of space (i.e., drive band space) between relief bands. Additionally, with respect to the relief band 200*a* shown in FIG. 2, it is noted that the profile 200 is bilaterally symmetrical about a central plane. However, it is contemplated that a projectile may be formed with a gas check that is not bilaterally symmetrical (e.g., only one half may be shaped according to the dimensional components discussed hereinafter) (not shown).

Inasmuch as the relief band 200*a* and drive band 200*b* are annular-shaped grooves around a cylindrical body, the cross-sectional view shown of the profile only includes a bisection of the projectile, where the bisection runs the length of the projectile. Moreover, since the groove shape may be repeated consecutively along the bearing surface of the projectile, only a single relief band 200*a* is shown. Further depicted are the dimensional components a-e, $\alpha$, and r, which are related to segments that define the profile of the section of a gas check according to the embodiment disclosed herein. The variable x corresponds to the rifling depth, as discussed further herein.

The dimensional components seen in FIG. 2, and the related equations for calculating the respective components (equations are described herein below), were created in an effort to balance 1) the need to reduce the surface area of the bearing surface of the projectile (e.g., a bullet), and 2) the desire to maximize aerodynamic performance. More specifically, by reducing the amount of surface area with the region of the conventional bearing surface of the projectile, the amount of potential friction is reduced between the projectile and the barrel from which the projectile is fired. Further, undesired pressure buildup may also be minimized at the time the projectile is fired.

As can be seen in FIG. 2, profile 200 does not include square-cut edges at transitions between the drive bands 200*b* and relief band 200*a*. Further, the transition edges are more than merely angled. Instead, the dimensional components a-e, α, and r of the profile define a collaboration of segments having varying lengths and/or angles, which segments combine to provide a detailed profile without any square-edges between the segments. That is, the profile is determined by calculating the specific dimensions of the individual segments. In a method of manufacturing, the calculated dimensions may then be implemented in a mold for injection molding or casting, and consistently shaped projectiles may thus be formed.

Figure 3:
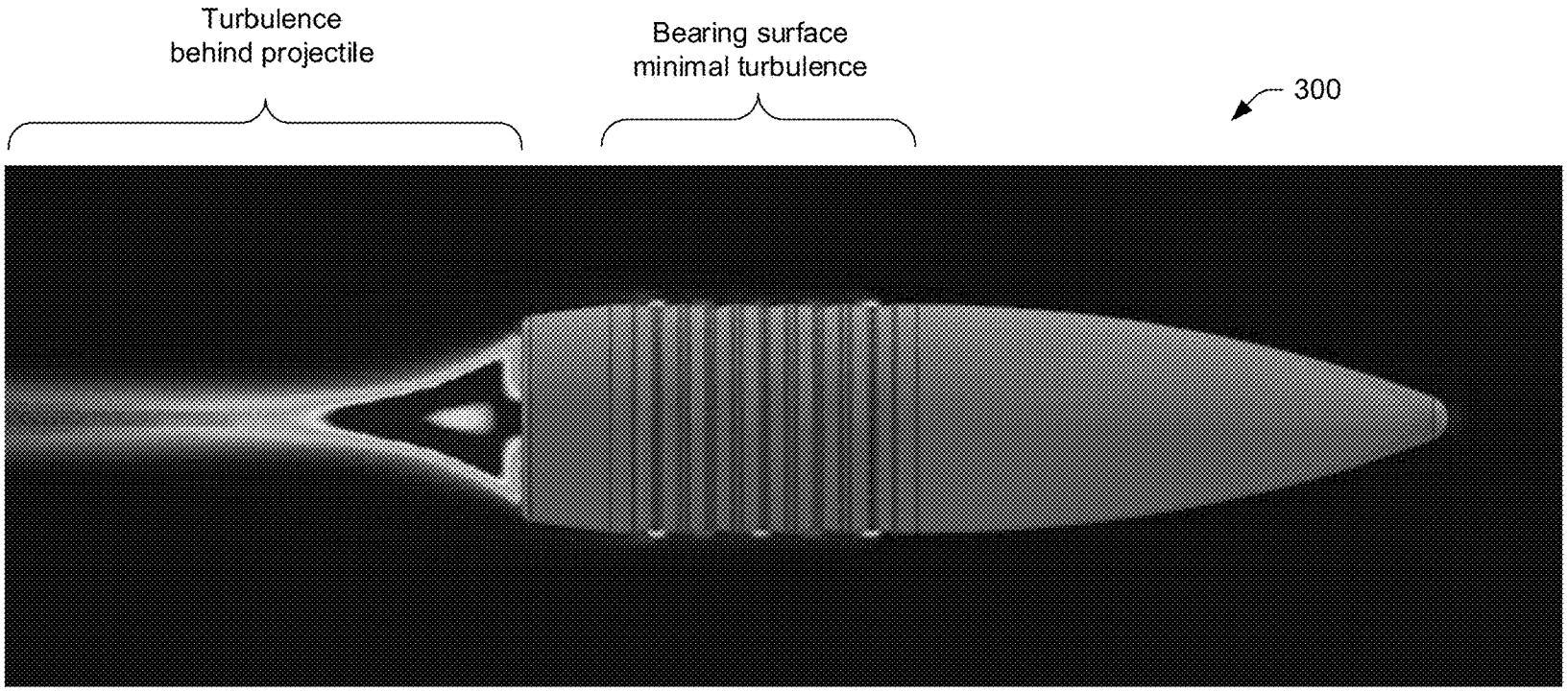
FIG. 3 illustrates turbulence on a projectile with a gas check formed according to an embodiment of the instant disclosure, as derived in FIG. 2.
Figure 4:
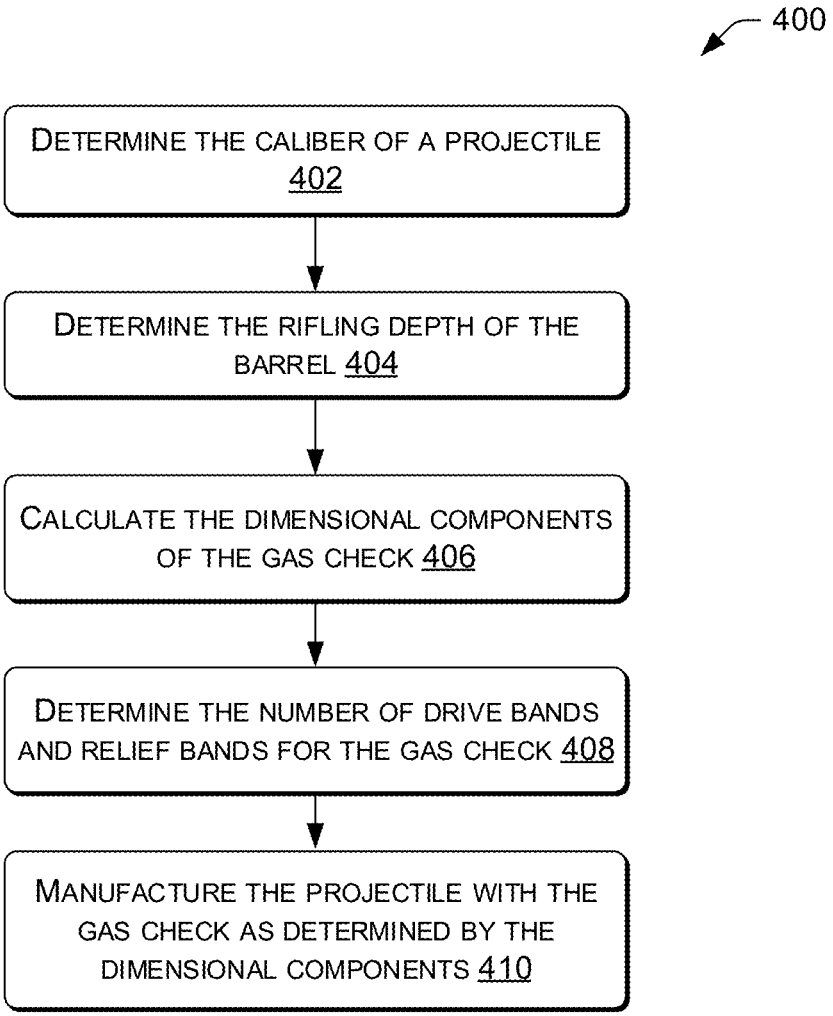
FIG. 4 illustrates a method of determining the dimensional components for projectiles according to an embodiment of the instant disclosure.

By implementing a gas check on a projectile having a profile that is specified according to the caliber of the projectile and calculated as described herein, it may be possible to minimize the turbulence that occurs along the bearing surface of the projectile during flight, as well as decrease the amount of turbulence that occurs to the rear of the projectile (see FIG. 3). Notably, the dimensional components a-e, α, and r, of the drive band and relief band account for the rifling depth of the barrel "x" and use a boat tail angle of 8.5 degrees to determine the ideal pattern of gas checks for the bearing surface of a projectile. As the only variable in the formulas for determining the shape of the relief band and drive bands is the rifling depth of the barrel x, the use of these dimensional components may be applicable across all calibers.

The dimensional component "a" refers to the length of the entire section of a repeating pattern 202 (which includes various segments discussed below), extending between the high points of the bearing surface across a relief band, and is repeated along the bearing surface, where a is calculated as follows:

$$a=18.125x$$

The dimensional component "b" represents the distance from a forward edge of the pattern 202 to the center of the pattern 202, extending from a high point on the bearing surface to a low point on the center of the relief band, which distance defines half of the entire repeating pattern. Thus, b is calculated as follows:

$$b=a/2$$

The dimensional component "c" represents the length of a bilaterally symmetrical central segment 204 located at the lowest point in the relief band from which the profile of the material of the projectile rises in both lateral directions. According to the instant disclosure, c is calculated as follows:

$$c=1.975x$$

The dimensional component "d" represents a portion, specifically half, of the length of the central segment 204 and extends horizontally outward from the central plane bisecting the relief band toward the drive band. Thus, d is calculated as follows:

$$d=c/2$$

From the outer end of the central segment 204, the profile of the relief band includes a rising segment 206 that extends transversely to the central segment, rising at an acute angle "α" toward the drive band. This angle α is set at about 8.5 degrees because, while a smaller angle, e.g., 7 degrees, may produce less turbulence, the smaller angle would either elongate the pattern 202 or reduce the depth of the cut (i.e., rifling depth of the barrel x), therefore making the relief band impractical.

The dimensional component "e" represents the length of an upper side segment 208 (i.e., part of the drive band) of the pattern 202, at the bearing surface, which ultimately meets the rising segment of the relief band. After determining the values of a-d and r (discussed below), e is easily determined by accounting for the predetermined value of α.

The dimensional component "r" refers to the radius of the curved segment 210 that extends between the end of the upper side segment 208 and the adjacent end of the rising segment 206 of the relief band. This radius r is calculated as follows:

$$r=7.5x$$

The number of drive bands and relief bands to be used is a function of the length of the bearing surface. Additionally, the rifling depth of the barrel x may be set at either the rifling depth or, alternatively, at 0.001" larger than the rifling depth. In an embodiment, testing showed that a rifling depth +0.001" may produce a greater reduction in pressure/friction than when the actual rifling depth is used. However, the width of the gas check also increases and whether the increase in width can be used on a particular projectile is determined by the length of the bearing surface of the particular projectile. In another embodiment, a mix-and-match of variable depth grooves may be used.

FIG. 3 illustrates a projectile 300 (e.g., a bullet) having a gas check across the bearing surface, where the gas check implements the profile defined by the dimensional components discussed above. As depicted, the gas check on the bearing surface causes a minimal amount of turbulence, shown as white dots just at the very edge of the bearing surface formed primarily at some of the relief bands. However, despite the minimal increase in turbulence along the outermost diameter of the bullet when fired, the turbulence is minimized behind the projectile 300, therefore improving stability overall and increasing speed capabilities. That is, the turbulence at the rear of the projectile 300 is less than the turbulence at the rear of projectile 100A and projectile 100B, shown in FIG. 1.

In addition to an apparatus of a projectile manufactured with a gas check according to the calculated dimensional components discussed above, a method 400 of determining the dimensional components for projectiles and manufacture thereof is also described herewith. The method 400 may include determining the caliber of a projectile (e.g., bullet, artillery, etc.) for which a gas check is desired, in step 402. In step 404, the rifling depth of the barrel x used for directing the projectile is determined based, at least in part, on the determined caliber. The rifling depth value is assigned to the variable "x" for further calculation with the above-described formulas. Note, the determination of the rifling depth value may include increasing that value by 0.001 inch. Step 406 includes calculating the dimensional components a-e and r of the gas check with respect to the rifling depth of the barrel x and a predetermined α. Next, the number of drive bands and relief bands is determined based, at least in part, on the length of the bearing surface of the projectile, in step 408. Step 410 includes manufacturing the projectile with the gas check as determined by the dimensional components calculated. In an embodiment, the projectile is manufactured via injection molding and/or casting.

Testing

In an effort to show the superiority of flight performance of a projectile having a gas check profile according to the dimensional components a-e, α, and r, as discussed above, the inventors test fired 10 samples of each of three different types of projectiles. All sample projectiles were the same caliber and were fired using the same firearm. The difference between the three types of projectiles is only in the provision, or lack of, a gas check of either a traditional gas check or a gas check as disclosed herein. In the test, when each sample was fired, the resultant pressure (measured in pounds per square inch "PSI") that developed in the chamber of the firearm was recorded. Additionally, the velocity (measured in feet per second "FPS") of each sample projectile was recorded from the same position with respect to the firearm. The results were tabulated and are provided here in TABLE 1 below. The three different types of projectiles are labeled as: "Smooth," "Traditional Gas Check," and "Improved Gas Check."

The smooth projectile has no gas check, but rather has a continuously planar cross-sectional profile across the entire length of the bearing surface. Thus, the smooth projectile has a cylindrical shape of a constant diameter across the length of the bearing surface.

The traditional gas check projectile has a common square-cut gas check in which the bearing surface includes annular grooves formed in the bearing surface such that the sidewalls of the grooves (and likewise the direction of the depth of the grooves) extend radially perpendicular to the surface profile. Thus, the diameter across the length of the bearing surface varies from a drive band area to a relief band area.

Figure 1:
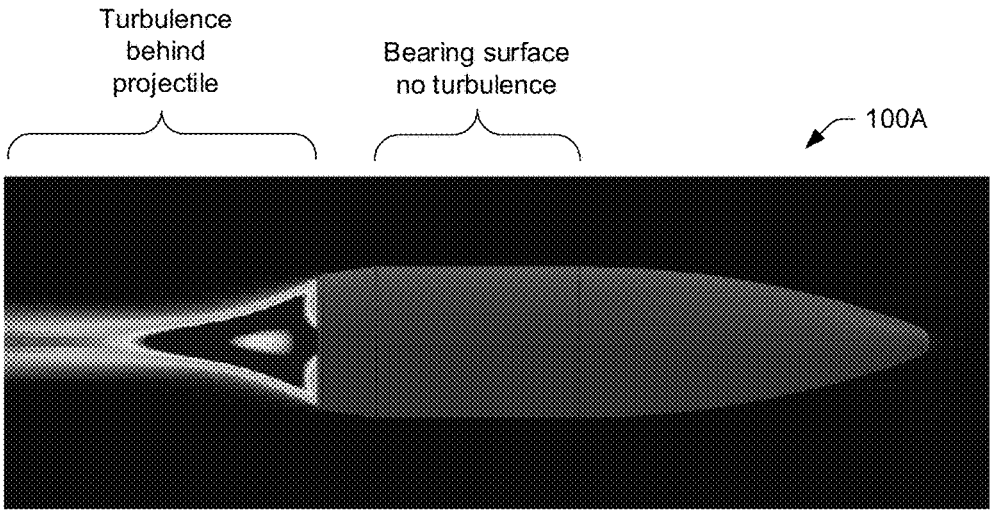
Related Art FIG. 1
FIG. 1 illustrates turbulence on a projectile without a gas check and on a projectile with a gas check using square-cut drive bands and relief bands.
Figure 1:
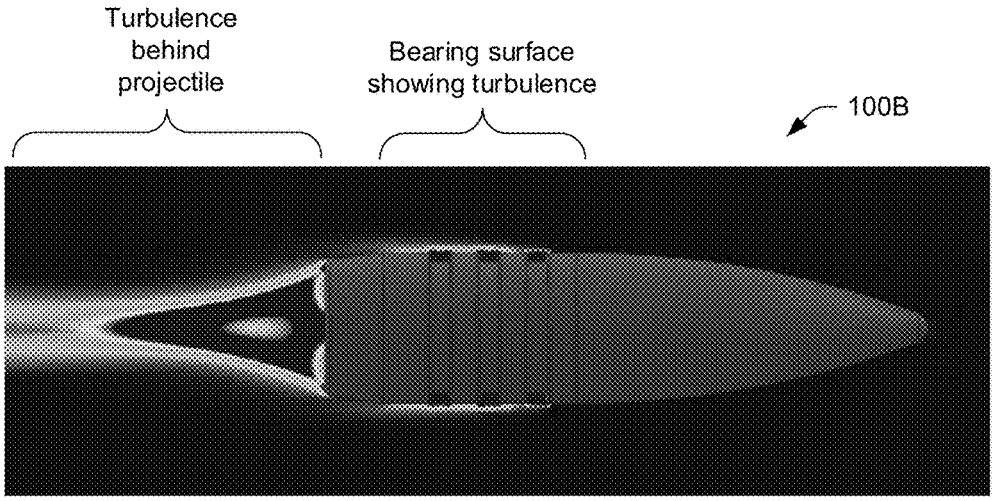
Related Art FIG. 1

To be clear, the profile of the traditional gas check has a "square" transition edge between the repeating drive bands and relief bands (see 100B in FIG. 1 for an example). In other words, the term "square-cut," as used above with respect to the gas check, relates to the abrupt intersecting surface planes at the edges of the transitions from the bearing surface and drive bands to the relief bands. Further, the use of the word "cut" does not necessarily mean that the gas check was physically cut into the bearing surface of the projectile. While it is possible that a gas check could be cut into a projectile, as mentioned above, the gas check on a projectile may be formed by other methods, such as molding the projectile with the gas check profile in the mold. Moreover, using molding methods instead of shaping the gas check by hand or even by a machine post-formation of the base projectile will likely create more consistency in the gas check produced.

The projectile labeled as the improved gas check projectile has a gas check with a profile shape that is formed based on the results of calculating the values of the dimensional components as discussed above with respect to the instant disclosure, which depends on the caliber of the projectile.

Other than the gas check, or absence thereof as in the smooth projectile, the remaining dimensions of the three tested projectiles were equivalent (e.g., the overall length, the shape of the head, boattail, base, heel, etc.). Furthermore, the material from which the projectiles were made is the same, and the projectiles were manufactured on the same equipment to the same tolerance.

TABLE 1

| Test round | PSI | FPS |
|---|---|---|
| | Smooth | |
| 1 | 47,702 | 1,981 |
| 2 | 50,513 | 2,014 |
| 3 | 50,896 | 1,996 |
| 4 | 50,686 | 1,994 |
| 5 | 49,510 | 1,979 |
| 6 | 51,014 | 1,998 |

TABLE 1-continued

| Test round | PSI | FPS |
|---|---|---|
| 7 | 47,854 | 2,002 |
| 8 | 48,166 | 1,974 |
| 9 | 49,897 | 1,986 |
| 10 | 45,890 | 1,971 |
| Avg. | 49,213 | 1,990 |
| High | 51,014 | 2,014 |
| Low | 45,890 | 1,971 |
| E.S. | 5,124 | 43 |
| | Traditional Gas Check | |
| 1 | 47,702 | 2,008 |
| 2 | 46,432 | 2,004 |
| 3 | 48,554 | 1,996 |
| 4 | 46,319 | 2,016 |
| 5 | 44,651 | 2,030 |
| 6 | 46,778 | 2,003 |
| 7 | 45,937 | 2,009 |
| 8 | 44,487 | 2,005 |
| 9 | 47,460 | 2,024 |
| 10 | 44,088 | 2,009 |
| Avg. | 46,241 | 2,010 |
| High | 48,554 | 2,030 |
| Low | 44,088 | 1,996 |
| E.S. | 4,466 | 34 |
| | Improved Gas Check | |
| 1 | 47,291 | 2,011 |
| 2 | 45,929 | 2,005 |
| 3 | 49,049 | 2,024 |
| 4 | 49,043 | 2,018 |
| 5 | 49,407 | 2,013 |
| 6 | 46,136 | 2,005 |
| 7 | 46,953 | 2,006 |
| 8 | 50,033 | 2,018 |
| 9 | 47,039 | 2,022 |
| 10 | 48,323 | 2,015 |
| Avg. | 47,920 | 2,014 |
| High | 50,033 | 2,024 |
| Low | 45,929 | 2,005 |
| E.S. | 4,104 | 19 |

As shown in TABLE 1, pressure and velocity measurements for the three different projectiles show an expected reduction of Maximum Average Pressure (MAP) from the projectiles having the traditional gas check and the improved gas check as compared to the smooth projectiles. Further, the projectiles with a gas check also showed an increase in velocity compared to the smooth projectiles. Notably, while the average pressure reduction in the projectiles with the improved gas check did not reach quite the same amount of reduction as that of the projectiles with traditional gas checks, the average velocity was higher, and the extreme spread (E.S.) was significantly less in both the pressure and velocity compared to the E.S. of both the traditional gas check projectiles and the smooth projectiles. For example, the E.S. of the velocity of the projectiles with an improved gas check is a near 45% improvement over the projectiles with a traditional gas check. Therefore, the resulting conclusion is that a projectile using an improved gas check according to the instant disclosure may provide more consistent projectiles. Such consistency in the performance of a projectile is strongly desired by users in the industry.

Conclusion

Although several embodiments have been described in language specific to structural features and/or methodological acts, it is to be understood that the claims are not necessarily limited to the specific features or acts described. Rather, the specific features and acts are disclosed as illustrative forms of implementing the claimed subject matter.

What is claimed is:

1. A projectile, comprising:

a body having a length and a width;

a bearing surface that extends cylindrically across a portion of the body in a direction of the length of the body; and a gas check formed in the bearing surface, the gas check including at least one relief band, the at least one relief band extending annularly through the bearing surface in a direction of the width of the body, wherein, in a planar cross-section of the at least one relief band taken through the width of the body and extending along the length of the body, a profile of the at least one relief band is bilaterally symmetrical about a central plane, and a shape of the profile on a side of the central plane is defined by a plurality of intersecting segments, including:

a central segment portion located at a lowest point of the profile, an upper side segment located at a highest point of the profile, a rising segment that extends at an acute angle from the central segment portion toward the upper side segment, and a curved segment that connects the upper side segment and the rising segment.

2. The projectile according to claim 1, wherein the at least one relief band includes at least two relief bands, and wherein the gas check further includes a drive band disposed between the at least two relief bands, the drive band having an outer diameter equivalent to an outer diameter of the bearing surface.

3. The projectile according to claim 1, wherein a dimensional size of the segments of the plurality of segments is based, at least in part, on a rifling depth of a barrel sized to correspond with use of the projectile.

4. The projectile according to claim 3, wherein the dimensional size of the segments of the plurality of segments is further based by increasing the rifling depth of the barrel by 0.001 inch.

5. The projectile according to claim 3, wherein the dimensional size of the central segment portion is determined by dividing in half a value calculated as 1.975 times the rifling depth of the barrel.

6. The projectile according to claim 3, wherein a radius of the curved segment is determined by multiplying 7.5 times the rifling depth of the barrel.

7. The projectile according to claim 3, wherein a length of the shape of the profile on the side of the central plane is determined by dividing in half a value calculated as 18.125 times the rifling depth of the barrel.

8. The projectile according to claim 1, wherein the acute angle at which the rising segment extends is about 8.5 degrees.

9. The projectile according to claim 1, wherein the gas check extends across a portion of the bearing surface such that a sequence of a plurality of relief bands are formed between drive bands having a diameter equivalent to an outer diameter of the bearing surface.

* * * * *